United States Patent [19]

Fischer

[11] Patent Number: 5,028,044

[45] Date of Patent: Jul. 2, 1991

[54] ROTARY FEEDER FOR BLANKS

[76] Inventor: Wilhelm Fischer, Weidacher Str. 1-3, D-8968 Durach, Fed. Rep. of Germany

[21] Appl. No.: 465,511

[22] Filed: Jan. 17, 1990

Related U.S. Application Data

[63] Continuation of Ser. No. 177,521, filed as PCT EP87/00628 on Oct. 23, 1987, abandoned.

[30] Foreign Application Priority Data

Oct. 31, 1986 [DE] Fed. Rep. of Germany ..... 3637182

[51] Int. Cl.[5] ..... B65H 3/40

[52] U.S. Cl. ..... 271/91; 271/95; 271/101

[58] Field of Search ..... 271/95, 31.1, 91, 101, 271/5, 11, 93; 414/797, 797.3, 797.7, 797.8

[56] References Cited

U.S. PATENT DOCUMENTS

| | | | |
|---|---|---|---|
| 2,568,604 | 9/1951 | Bechberger . | |
| 2,827,287 | 3/1958 | Gross et al. | 271/95 X |
| 3,385,595 | 5/1968 | Benatar et al. | 271/95 |
| 3,416,786 | 12/1968 | Stobb . | |
| 3,521,879 | 7/1970 | Niemeyer | 271/95 |
| 3,650,525 | 3/1972 | Hageman et al. | 271/101 |
| 3,720,409 | 3/1973 | Kubo et al. | 271/95 |
| 3,937,458 | 2/1976 | Langen | 271/95 |
| 4,194,442 | 3/1980 | Martelli | 271/95 X |
| 4,283,047 | 8/1981 | Blessing | 271/10 |
| 4,350,466 | 9/1982 | Bahr et al. | 271/95 X |
| 4,482,145 | 11/1984 | Feldkamper et al. | 271/95 |
| 4,491,311 | 1/1985 | Glanzmann | 271/31.1 X |
| 4,501,416 | 2/1985 | Hain | 271/95 X |
| 4,518,301 | 5/1985 | Greenwell | 271/31.1 X |
| 4,542,894 | 9/1985 | Feldkamper et al. | 271/95 X |

FOREIGN PATENT DOCUMENTS

| | | | |
|---|---|---|---|
| 420214 | 3/1967 | Switzerland | 271/95 |

OTHER PUBLICATIONS

Power Drives: Classified with a View to Promoting Inventions, G. Vander Haeghen (Second Edition, 1957), p. 126.

*Primary Examiner*—David H. Bollinger
*Attorney, Agent, or Firm*—Cushman, Darby & Cushman

[57] ABSTRACT

In order to increase considerably the output of a rotary feeder (6) for removing individual blanks (1) from a stack (2), the invention proposes that the speed of the rotary movement of rotary suckers (7) is slowed down while they are being pressed against the blank (5) that is to be removed. This retardation operation is brought about by a special gear unit that drives a rotor (12) to which the rotary suckers (7) are attached.

5 Claims, 3 Drawing Sheets

ROTARY FEEDER FOR BLANKS

This is a continuation of application Ser. No. 07/177,521, filed as PCT EP87/00628 on Oct. 23, 1987, which was abandoned upon the filing hereof.

BACKGROUND OF THE INVENTION

The invention relates to a rotary feeder for removing individual blanks from a stack, which operates by positioning a row of suckers against the blank at the front of the stack in the course of an at least partial rotary movement and then moving these suckers in a continuation of the rotary movement to a conveyor for transporting the individual blanks away.

Blanks are taken to mean sheets, cartons or similar objects which are subsequently processed, formed or treated in some other way. The packaging industry is a major application area for such feeders. In this case the blanks are formed into folding cartons, filled with a product and then closed.

In a process used in practice, the front blank of a stack of blanks is positioned at an acute angle to a conveyor located below the stack. An oscillating rotary feeder, which uses suckers to take hold of the blank at the front of a stack of blanks and turns to place the blank on the conveyor, is provided in the area of this acute angle. Only a relatively small number of blanks (for example 100 blanks/minute) can be fed by such a process, which is attributable to the fact that the return movement of the feeder rules out an increase in output.

A solution has also been used which involves stopping the rotary movement of the rotary suckers so that the latter can take hold of the blank at the front of a stack and then feed the blank to a conveyor in a continuation of the rotary movement. Such arrangements are not, however, capable of producing major increases in blank feeding output either.

SUMMARY OF THE INVENTION

The aim of the invention is therefore to develop a feeder for blanks with which it is possible to increase the output of the feeder considerably, for example to double it.

In the solution to this problem proposed by the invention, the rotary movement of each row of suckers is slowed down while a blank is being removed from the stack. To this end, it is advisable to attach each row of suckers to a permanently driven rotor and to equip the rotor drive with a retarding gear unit.

According to the idea behind the invention, the feeder proposed by the invention appears to rotate continuously along a stack of blanks. While the blank at the front of the stack is taken hold of and removed by suction, the rotary movement of the feeder is retarded, which leads to proper application of suction to and removal of the blank at the front of the stack of blanks. This retardation phase is compensated for by an acceleration phase, before the removed blank is transferred to the conveyor.

In a preferred embodiment of the invention it is provided that each row of suckers is connected to a swivelling shaft incorporated in the rotor and that a gear wheel or similar device that is fixed to this shaft turns with a gear wheel fixed to the shaft of the rotor via an intermediate gear wheel. This makes it possible to drive the rotor and thus the individual row of suckers. A further possibility this creates is to give the individual row of suckers a superimposed rotary movement of its own, as a result of which the individual sucker can be pressed against the front blank in the stack in a retarded movement, so that the blank can be taken hold of the suction and removed from the stack of blanks.

One embodiment of the invention provides for the rotation curve travelled by the end of the suckers to penetrate slightly the level of the surface of the blank at the front of the stack, the retardation of the rotary movement of the rotor taking place in the course of this penetration phase. As a result of this, the individual sucker pushes the front blank and thus also the whole of the stack of blanks backwards, which is necessary so that the front blank in the stack can be removed from the blank retaining device.

For this purpose the invention proposes the inclusion of bar-like supports for the blank at the front of the stack of blanks, which can be moved to and fro along the stack in such a way that the supports are close to the suction point when the suckers are applied to the front blank and are located a distance away when this blank is removed.

Movement of the supports in this way can be combined without any difficulty with the rotation of the rotor to which the suckers are attached.

The object of the invention also includes a gear unit that is inventive in itself, that is designed to make a rotor driven continuously by a motor carry out periodically retarded rotary movements and that can be used in particular for a feeder constructed in accordance with the invention.

Changing continuous rotary movements into retardation and acceleration phases is in itself a familiar practice, achieved for example by the use of elliptical gear wheels.

The purpose of the present invention is, however, to make such a retardation of the rotary movement possible during a continuous drive operation on the basis of the simplest possible design, particularly the use of standard gear wheels. The invention solves this problem by proposing a pair of gear wheels that are constantly in mesh, the driving gear wheel being eccentrically pivoted and the driven gear wheel being pivoted in a lever arm, while the driven gear wheel meshes with a drive wheel located on the lever arm shaft and the lever arm is subject to a force that compels the pair of gear wheels to remain in mesh.

In a preferred embodiment of the invention a sliding element, e.g. a roller, that is pivoted on the lever arm, is located in a track of a disc which is fixed to the driving wheel of the pair of gear wheels. This arrangement forces the pair of gear wheels to remain meshed constantly.

The most effective position for the suckers when they press against the blank at the front of the stack is therefore achieved simply by adjusting the setting of the above-mentioned eccentric drive in relation to the position of the suckers.

The object of the invention also includes a particularly effective suction system, the purpose of which is to facilitate the suction and release of the blanks in the course of the rotary movement of the rotor/suckers. To this end, the invention proposes that the suction supply line of each row of suckers leads via a rotor disc to the surface of a fixed disc, on which the rotor disc rests. Channels of limited length, that extend along a circular path in the area in which the suction opening of the suction supply line moves, are provided in the fixed disc. At least one of these channels is connected to a vacuum source, while another one is connected to the outside air.

When the rotor disc with the suction opening moves along a channel that is connected to a vacuum source, then a vacuum is created in the individual suckers, which apply it to the blank in the front of the stack. When, on the other hand, the suction opening reaches the channel that is connected to the outside air, the vacuum in the suction supply line is released spontaneously, with the result that the blank which has been removed by suction immediately drops onto the conveyor.

BRIEF DESCRIPTION OF THE INVENTION

The details of the invention can be seen in the drawings, which show the invention in exemplary, diagrammatic form:

FIG. (1) is a diagrammatic side view of a feeder with rotary suckers,

FIGS. (2–4) are enlarged side views of the suckers in different positions of the suction process, FIG. (5) is a side view of a retarding gear unit and FIGS. (6 and 7) are a cross-section and front view of a system for the controlled suction and release of blanks.

DETAILED DESCRIPTION OF THE INVENTION

Figure 1:
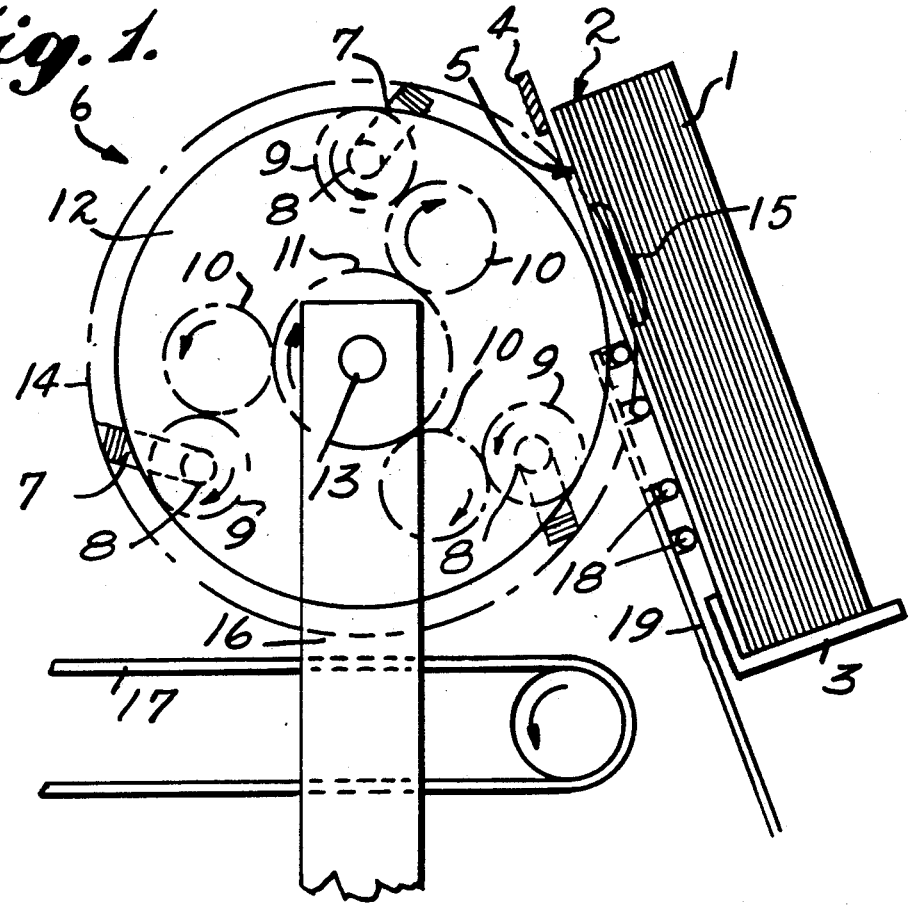
Figure 2:
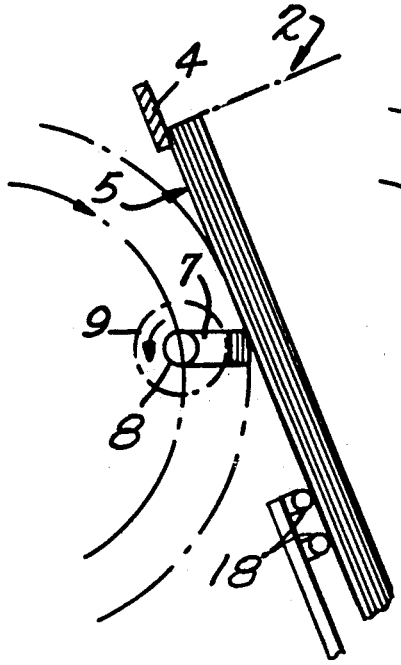
Figure 3:
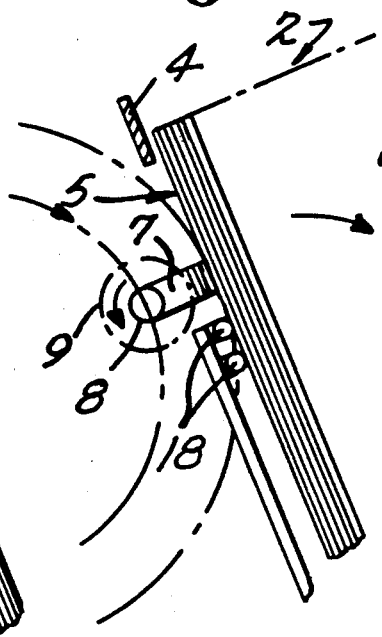
Figure 4:
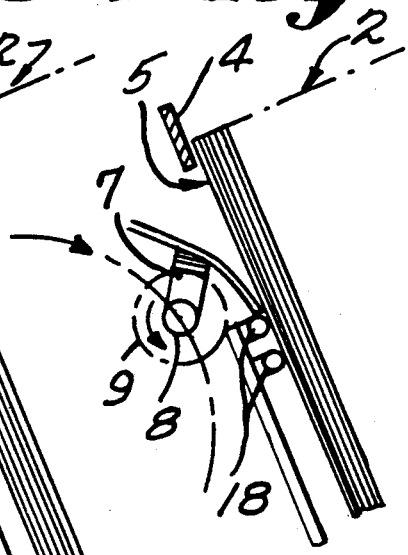
Figure 5:
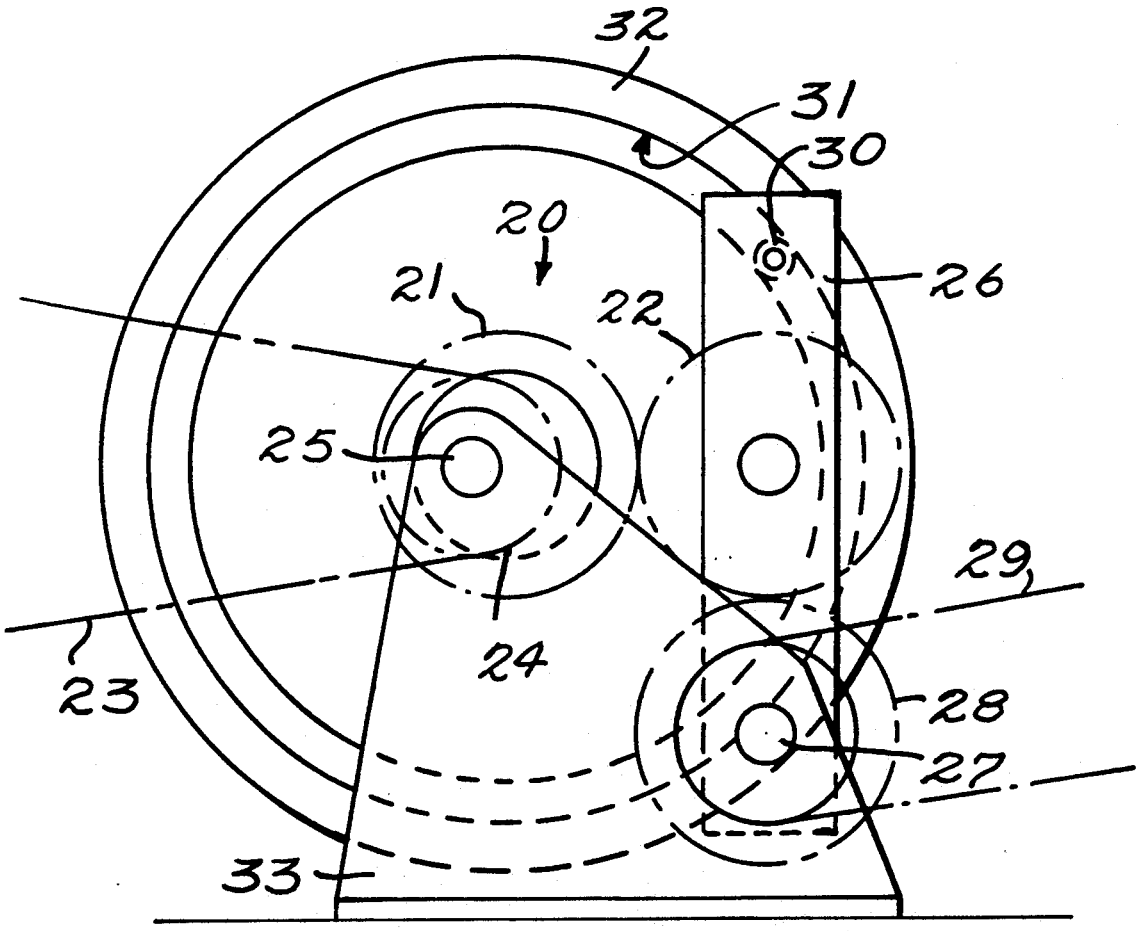
Figure 6:
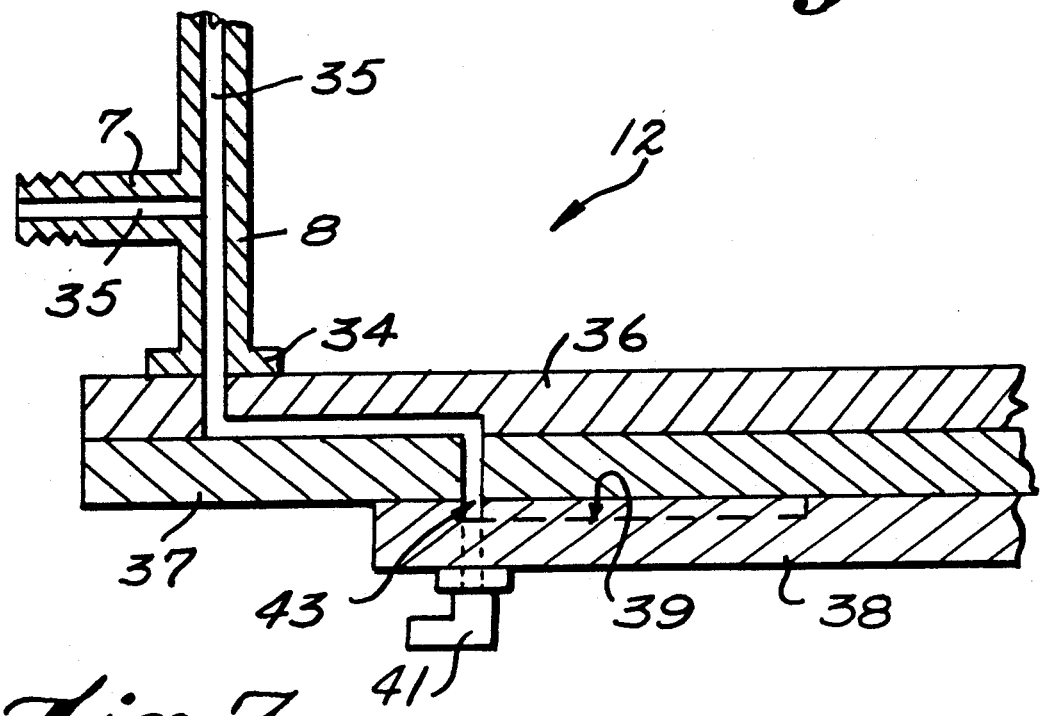
Figure 7:
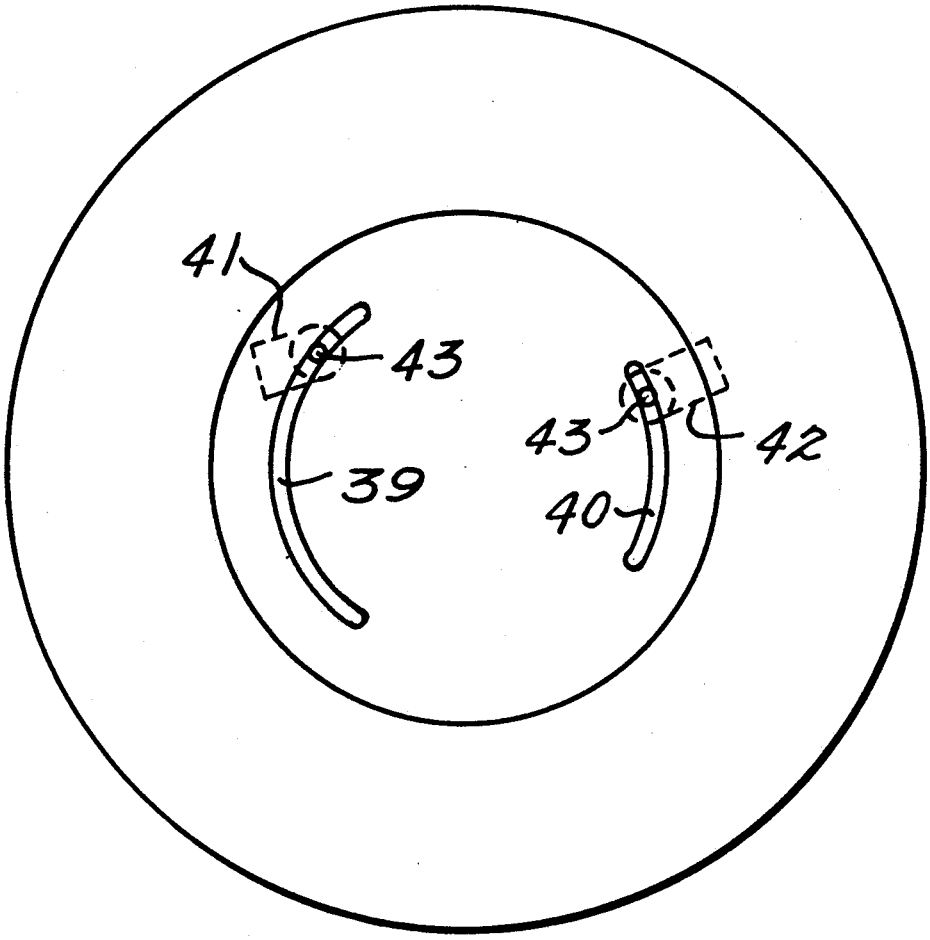

The embodiment in FIG. (1) shows a stack of blanks (2) which is arranged so that the individual blank (5) at the front of the stack (2) can be removed and placed on a conveyor (17). The individual blank (1) in the stack (2) rests on a retaining element (3) and is held at its top end by a stop (4). The top edge of the blank (5) at the front of the stack therefore has to get past this stop (4) when it is removed by suction.

FIG. (1) includes a diagram of a rotary feeder (6) to carry out this operation, which has at least one and preferably more rows of suckers (7). These suckers (7) are attached to a swivelling shaft (8) which is incorporated in a rotor (12). A gear wheel (9), which meshes—via an intermediate gear wheel (10)—with a fixed gear wheel (11) that is attached to the shaft (13) of the rotor (12), is located on the shaft (8). When the rotor (12) is turned around the rotor shaft (13) with the help of a special gear unit that will be described later, the meshing of the gear wheels (9, 10) with the fixed gear wheel (11) causes the individual suckers (7) to turn themselves, in the direction indicated in FIGS. (2) to (4).

In the example shown in FIG. (2) the edge of the front of the sucker (7) has reached the surface of the front blank (5). As FIG. (1) shows, the rotation curve (14) of the sucker does not just touch the surface of the front blank (5); it penetrates the level of this surface, which is indicated by the penetration area (15) in FIG. (1). This leads, as the sucker (7) continues to turn from the position in FIG. (2) to the position in FIG. (3) and to the position in FIG. (4), that is, opposite to the direction of rotation of the rotor 12, to compression of the sucker (7), which has a bellows construction at its end for this purpose. The compression of the sucker (7) is at its greatest in FIG. (3), after which it diminishes again.

During this phase (15) (cf. FIG. (1)) the rotary movement of the rotor (12) is retarded, as a result of which more time is available for the application of suction to the blank (5) at the front of the stack.

The support (18) moves its position along the stack of blanks (2) during the same phase. In the embodiment shown, the only support (18) consists of two rods which extend at right angles to the stack of blanks (2) and are mounted on a guide rod (19) that can oscillate parallel to the stack (2).

The individual phases of the movement are shown in enlarged form in FIGS. (2–4). In the example shown in FIG. (2) the front edge of the sucker (7) has reached the blank (5) at the front of the stack, at which point the suction operation begins. In the example shown in FIG. (3), the sucker (7) (or row of suckers (7)) has moved the stack of blanks (2) slightly away from the stop (4) and the suction force of the sucker (7) is taking full effect. During this phase the support (18) is located close to the sucker (7), so that the suction removal of the front blank (5) has to occur around the position of the support (18), which causes a slight bending radius. This makes it easy for the top edge of the front blank (5) to get past the fixed stop (4).

In the subsequent phase the sucker (7) removes the front blank (5), while the support (18) can return to its original position.

The invention thus indicates a possible way to make contact with, apply suction to and remove the front blank in a stack of blanks in the course of a retarded turning movement, without there being any need to stop the turning movement.

FIG. (5) shows a gear unit which enables this condition to be fulfilled. This gear unit is, however, inventive in its own right and can consequently be used for other comparable cases.

The gear unit shown in FIG. (5) has a pair of gear wheels (20), which consists of a driving gear wheel (21) and a driven gear wheel (22). The driving gear wheel (21) is driven by an external drive unit (23) via a drive wheel (24) which is located on an eccentric drive shaft (25).

The driven gear wheel (22) that is constantly in mesh with the driving gear wheel (21) is pivoted in a lever arm (26) which turns around the lever arm bearing (27). The eccentricity of the driving gear wheel (21) to the drive shaft (25) thus leads to a pendulum movement of the lever arm (26). A counter-force, which is exerted via the lever arm (26), is necessary so that the gear wheels (21, 22) of the pair of gear wheels (20) remain constantly in mesh. This counter-force can be provided by a spring.

FIG. (5), however, shows a different advantageous embodiment, in which a sliding element (30), for example a roller, is attached to the lever arm (26) and engages the track (31) of a disc (32). This disc (32) is fixed to the driving gear wheel (21) and is thus pivoted around the eccentric drive shaft (25).

The driven gear wheel (22) of the pair of gear wheels (20) meshes with an output drive wheel (28) that is pivoted around the lever arm shaft (27) and is connected to an output drive unit (29).

The rotation of the driving gear wheel (21) around the eccentric drive shaft (25) leads to an eccentric movement of the driving gear wheel (21) and the disc (32). The track (31) has to be positioned in the disc (32) in such a way that the driven gear wheel (22)—guided by the lever arm (26)—remains constantly in mesh with the driving gear wheel (21) despite the eccentric movement. In this way the rotary movement transferred to the output drive wheel (28) is periodically retarded and accelerated, with the result that the individual suckers (7) have a longer period of time to exert suction on the blank (5) at the front of the stack of blanks (2).

FIGS. (6 and 7) show an embodiment which facilitates the removal by suction of the individual blank (5) and the transfer of this blank (5) to the conveyor (17) (cf. FIG. (1)).

As has already been explained above, each sucker (7) is connected to a swivelling shaft (8) which is incorporated in a rotor (12). In the embodiment shown in FIG. (6) this rotor consists of the two rotor discs (36, 37), which form a single unit together but which also allow the suction supply line (35) to extend to the individual rotor discs (36, 37). The rotor disc (37) rests on a fixed disc (38) in the surface of which facing the rotor disc (37) channels (39, 40) are provided as shown in FIG. (7). The suction opening (43) of the suction supply line (35) is in alternate contact with the individual channels (39, 40). Channel (39) is connected to a vacuum source by connection (41). Channel (40), on the other hand, is connected to a connection (42) which has access to the outside air.

When the suction opening (43) is in contact with channel (39), a vacuum is therefore created in the sucker (7) to remove the front blank (5) by suction. However, when the suction opening (43) reaches the channel (40) that is connected to the outside air, the vacuum in the suction supply line (35) is immediately released, with the result that the blank (5) which has been removed by suction is spontaneously dropped onto the conveyor (17).

The position of the channel (40) can thus be adjusted to the turning position of the suckers (7) in relation to the conveyor (17), so that the blank (5) that has been removed by suction can be transferred effectively.

(1) Individual blank
(2) Stack of blanks
(3) Retaining element
(4) Stop
(5) Front blank
(6) Rotary feeder
(7) Sucker
(8) Shaft
(9) Gear wheel
(10) Intermediate gear wheel
(11) Fixed gear wheel
(12) Rotor
(13) Rotor shaft
(14) Rotation curve of the suckers
(15) Penetration area
(16) Bearing support
(17) Conveyor
(18) Support
(19) Guide rod
(20) Pair of gear wheels
(21) Driving gear wheel
(22) Driven gear wheel
(23) Drive unit
(24) Drive wheel
(25) Drive shaft
(26) Lever arm
(27) Lever arm shaft
(28) Output drive wheel
(29) Output drive unit
(30) Sliding element (roller)
(31) Track
(32) Disc
(33) Stand
(34) Bearing
(35) Suction supply line
(36) Rotor disc
(37) Rotor disc
(38) Fixed disc
(39) Channel
(40) Channel
(41) Connection to vacuum source
(42) Connection to outside air
(43) Suction opening

I claim:

1. A rotary feeder for removing individual blanks from a stack, said feeder including a rotor having spaced apart end walls and at least one shaft rotatably mounted between said end walls said shaft carrying at least one sucker means for engaging and holding an individual blank, means mounting said rotor for rotation and means for rotating said rotor including first gear means for transmitting rotary motion from a drive source to said means for rotating said rotor, second gear means for rotating said sucker means through a circular path and in a sense opposite to the rotation of said rotor so that, upon engaging and holding a blank, the sucker means will move the blank into said rotor as said rotor turns, said sucker means having an end which travels through said circular path upon rotation thereof with said circular path penetrating slightly the level of the surface of the blank at the front of the stack, said first gear means including means for retarding the rotary movement of said rotor while said sucker means is in that portion of its path of travel corresponding to the penetration of the level of the surface of the blank.

2. Feeder according to claim 1, wherein said sucker means includes a plurality of rows of suckers and each row of suckers (7) is attached to said rotor.

3. Feeder according to claim 2, wherein bar-like supports (18) for the blank (5) at the front of the stack (2) are included, which can be moved to and fro along the stack (2) in such a way that the supports (18) are close to the suction point when the suckers are applied to the front blank (5) and are located a distance away when this blank (5) is removed.

4. A feeder as claimed in claim 2, wherein each row of suckers is mounted on a separate shaft rotatably mounted between said end walls of said rotor.

5. A feeder as claimed in claim 1, wherein said sucker means includes a suction supply line which is connected to a passage in said rotor, said rotor being connected to a fixed disc on which said rotor rests, said fixed disc including channels which extend along a circular path and which are in communication with the suction opening of the suction supply line, one of said channels being connected to a vacuum source, while another one of said channels is connected to the atmosphere.

* * * * *